US009546081B2

(12) United States Patent
Kusian

(10) Patent No.: US 9,546,081 B2
(45) Date of Patent: Jan. 17, 2017

(54) POWER-ASSISTED WINCH

(71) Applicant: Anthony J. Kusian, Curtice, OH (US)

(72) Inventor: Anthony J. Kusian, Curtice, OH (US)

( * ) Notice: Subject to any disclaimer, the term of this patent is extended or adjusted under 35 U.S.C. 154(b) by 139 days.

(21) Appl. No.: 14/195,915

(22) Filed: Mar. 4, 2014

(65) Prior Publication Data

US 2014/0246634 A1 Sep. 4, 2014

Related U.S. Application Data

(60) Provisional application No. 61/772,112, filed on Mar. 4, 2013.

(51) Int. Cl.
*B66D 1/74* (2006.01)

(52) U.S. Cl.
CPC ..... *B66D 1/7436* (2013.01)

(58) Field of Classification Search
CPC ..... B66D 1/7426; B66D 1/7436; B66D 1/485
USPC ..... 242/323, 268, 269, 362, 613; 254/323, 254/268, 269, 362
See application file for complete search history.

(56) References Cited

U.S. PATENT DOCUMENTS

| | | | | |
|---|---|---|---|---|
| 2,709,867 | A * | 6/1955 | Routh | A01K 89/017 242/250 |
| 3,985,340 | A | 10/1976 | Guangorena | |
| 5,368,279 | A * | 11/1994 | Ottemann | B66D 1/7436 254/342 |
| 6,431,103 | B1 | 8/2002 | Meyerdierks | |
| 8,220,405 | B2 * | 7/2012 | Christensen | B63B 35/816 114/254 |
| 8,651,461 | B2 * | 2/2014 | Christensen | B66D 1/48 114/254 |
| 8,757,079 | B2 * | 6/2014 | Christensen | B63B 21/16 114/254 |
| 2013/0119329 | A1 * | 5/2013 | Fields | B66D 1/7484 254/323 |

* cited by examiner

*Primary Examiner* — Emmanuel M Marcelo
*Assistant Examiner* — Justin Stefanon
(74) *Attorney, Agent, or Firm* — Fraser Clemens Martin & Miller LLC; James D. Miller

(57) ABSTRACT

A power-assisted winch includes a rotatable drum for receiving a line thereabout. The power-assisted winch further includes a trigger mechanism configured to be releasably engaged upon a force exerted on the line. The trigger mechanism selectively activates a power source providing power to the winch to assist with hauling the line when engaged.

14 Claims, 5 Drawing Sheets

POWER-ASSISTED WINCH

This application claims priority to U.S. Provisional Patent Application Ser. No. 61/772,112 filed Mar. 4, 2013, hereby incorporated herein by reference in its entirety.

FIELD OF THE INVENTION

The present invention relates to a winch, and more particularly to a power-assisted winch having a power source which activates when a pulling force is exerted on a line and deactivates when the pulling force is relaxed.

BACKGROUND OF THE INVENTION

Winches find widespread use in various applications. One important and widespread area of use of winches today is for pulling in lines attached to sails and anchors on sailing vessels and other boats. However, winches find various other applications including use on recreational vehicles and in industrial applications.

Conventional winches typically include a rotating drum that captures the line through friction in a desired direction. The rotating drum is commonly engaged using a manual crank that is attached to a spline and usually a means of gear reduction. More recently, electric and hydraulic power-assisted winches have been utilized to use electric or hydraulic motors instead of a manual crank to input torque to the rotating drum of the winch. These winches are commonly activated using an input control such as a button or switch. In some cases, these winches can be operated in the reverse direction, allowing sails to be trimmed at the push of a button. While the electric and hydraulic assisted winches provide assistance in pulling in and trimming sails without the manual crank used in conventional winches, they still require a user to operate a button or switch to engage the winch. While operation of the button or switch is not difficult, it still requires the user to free a hand from the line being pulled. This can become cumbersome when performing such sailing maneuvers as a tack or jibe where the user would have to switch from a winch on a starboard side of the sailing vessel to a winch on a port side of the sailing vessel or vise versa.

Thus, it would be desirable to operate a winch by pulling on the line in the desired direction without having to operate a manual crank or button. This would provide a more intuitive approach than the winches of prior art, especially during various sailing maneuvers.

Accordingly, it is further desirable to produce a power-assisted winch having a power source which activates when a pulling force is exerted on a line and deactivates when the pulling force is relaxed.

SUMMARY OF THE INVENTION

In concordance and agreement with the present invention, a power-assisted winch having a power source which activates when a pulling force is exerted on a line and deactivates when the pulling force is relaxed, has surprisingly been discovered.

According to an embodiment of the invention, a power-assisted winch is disclosed. The power-assisted winch includes a rotatable drum for receiving a line thereabout and a trigger mechanism configured to be releasably engaged upon a force exerted on the line. The trigger mechanism selectively activates a power source providing power to the winch to assist with hauling the line when engaged.

According to another embodiment of the invention, a power-assisted winch is disclosed including a power source providing power to the winch for hauling a line. The power-assisted winch further includes a rotatable drum for receiving the line thereabout and coupled to the power source. A mounting assembly is coupled to the rotatable drum and configured to engage with a trigger mechanism which selectively activates the power source when engaged.

According to a further embodiment of the invention, a method of hauling a line using a power-assisted winch. The method including the steps of guiding a line about a rotatable drum, exerting a force on the line, and releasably engaging a trigger mechanism upon the force exerted on the line to selectively activate a power source providing power to the winch to assist with hauling the line.

DESCRIPTION OF THE DRAWINGS

The above, as well as other advantages of the present invention, will become readily apparent to those skilled in the art from the following detailed description, when considered in the light of the accompanying drawings.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
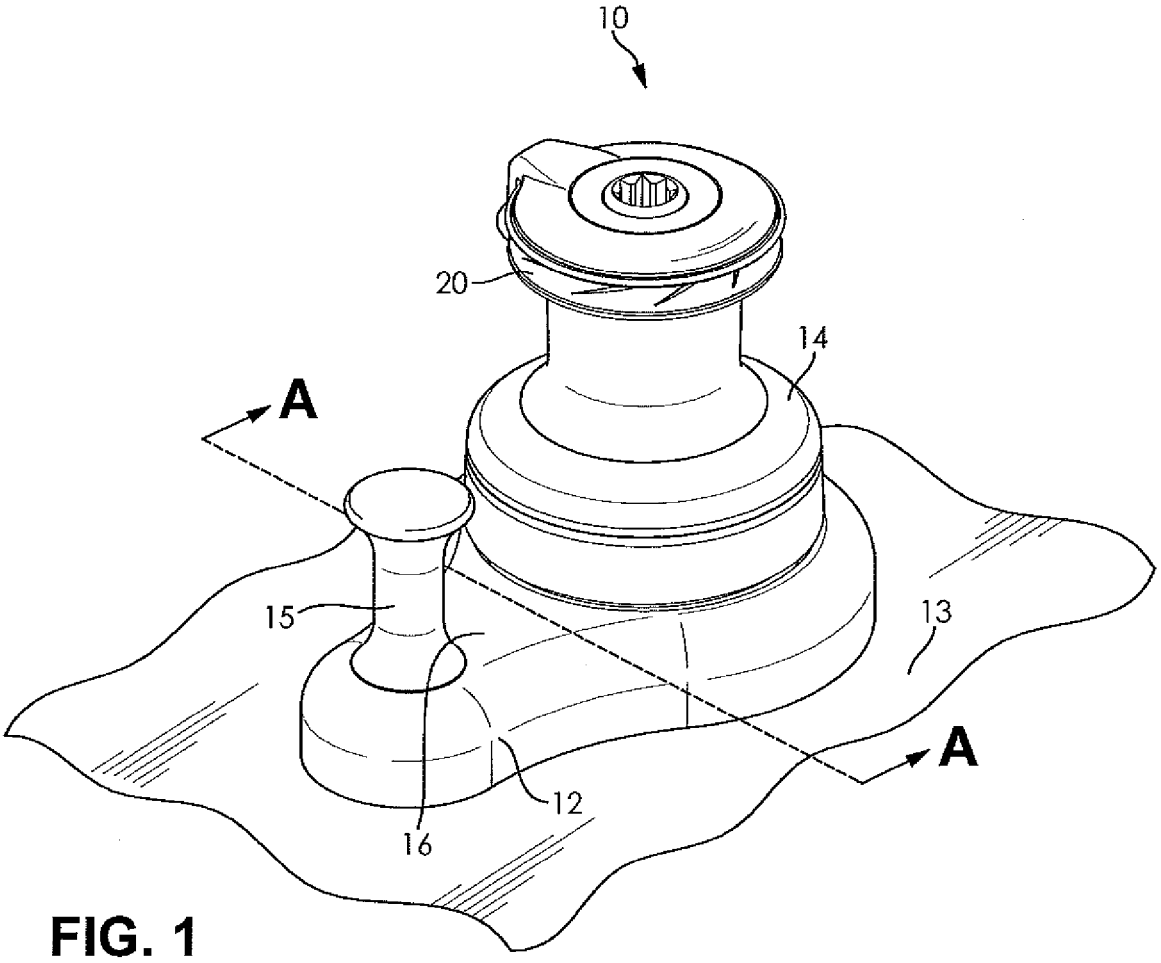
FIG. 1 is a top perspective view of a power-assisted winch according to an embodiment of the invention, wherein the winch includes a base having a rotatable drum and a fairlead coupled thereto.

FIG. 1 shows a winch 10 for hauling and passing sheets or halyards of sailing vessels. The winch 10 can be used for various other applications including use on recreational vehicles and in industrial applications. The winch 10 shown includes a foot or base 12 for mounting the winch 10 to a portion of the sailing vessel 13 (e.g. a deck, a cockpit sill, a mast, etc.), a rotatable drum 14 configured to receive a line, cable, or rope (collectively referred to as the "line" hereinafter) thereabout, and a fairlead 15 to guide the line around the drum 14. In certain embodiments, the fairlead 15 guides the line around the drum 14 in such a manner that a direction of a wind load exerted on the line is substantially perpendicular to a direction of a pulling force exerted on the line by the user to minimize forces exerted on the line opposite the pulling force. Various fairleads 15 can be employed such as pulleys, eye bolts, posts, and the like, for example. In other certain embodiments, the winch 10 can be operated without the fairlead 15 if desired.

Figure 2:
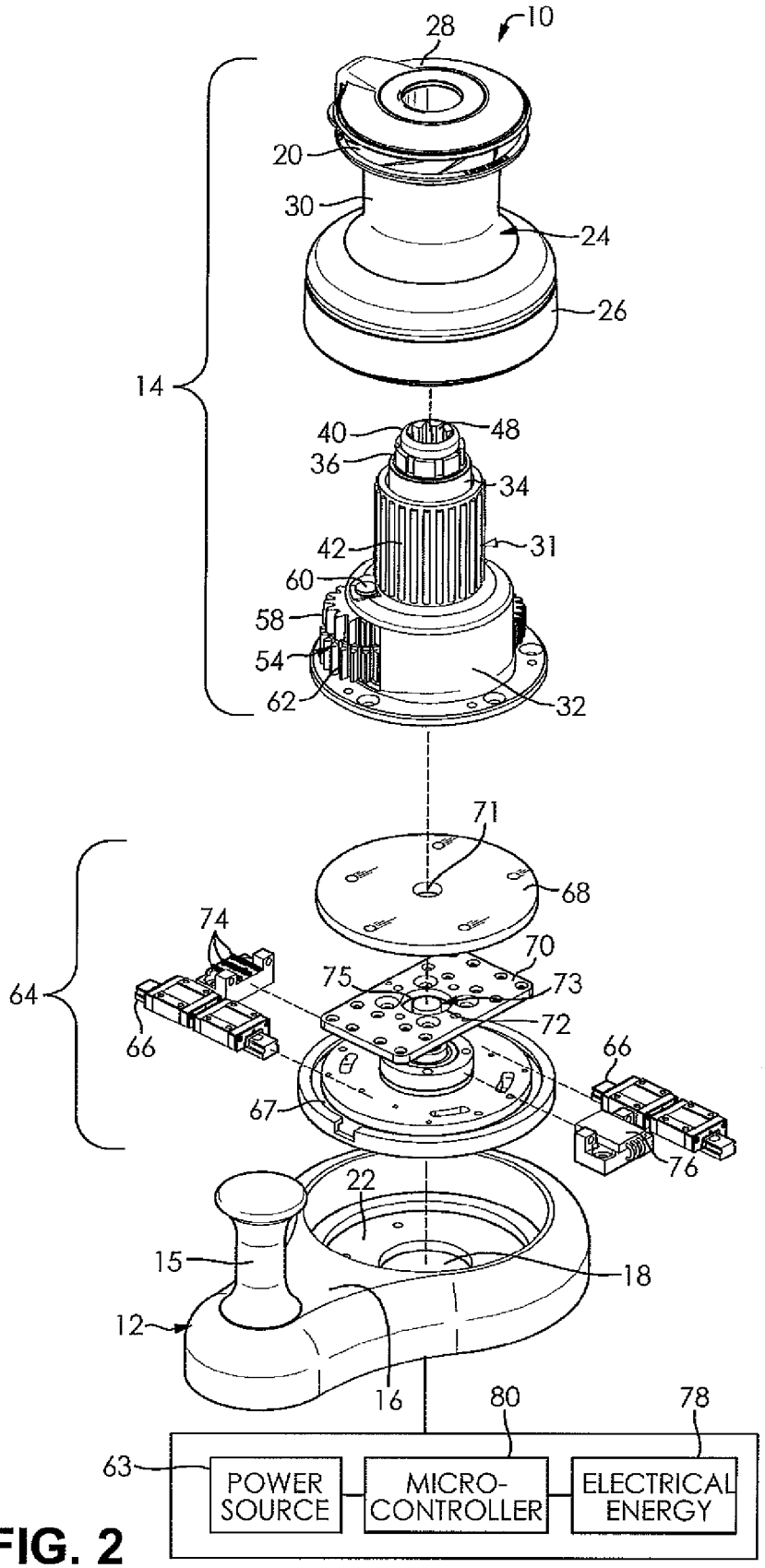
FIG. 2 is a partially exploded top perspective view of a power-assisted winch and mounting assembly according to an embodiment of the invention.
Figure 3:
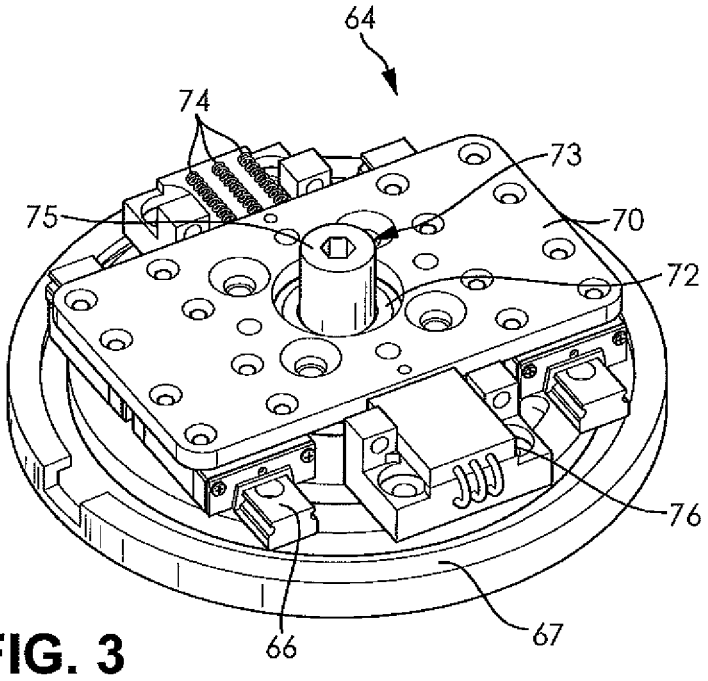
FIG. 3 is a top perspective view of a mounting assembly of the power-assisted winch of FIG. 2.
Figure 4:
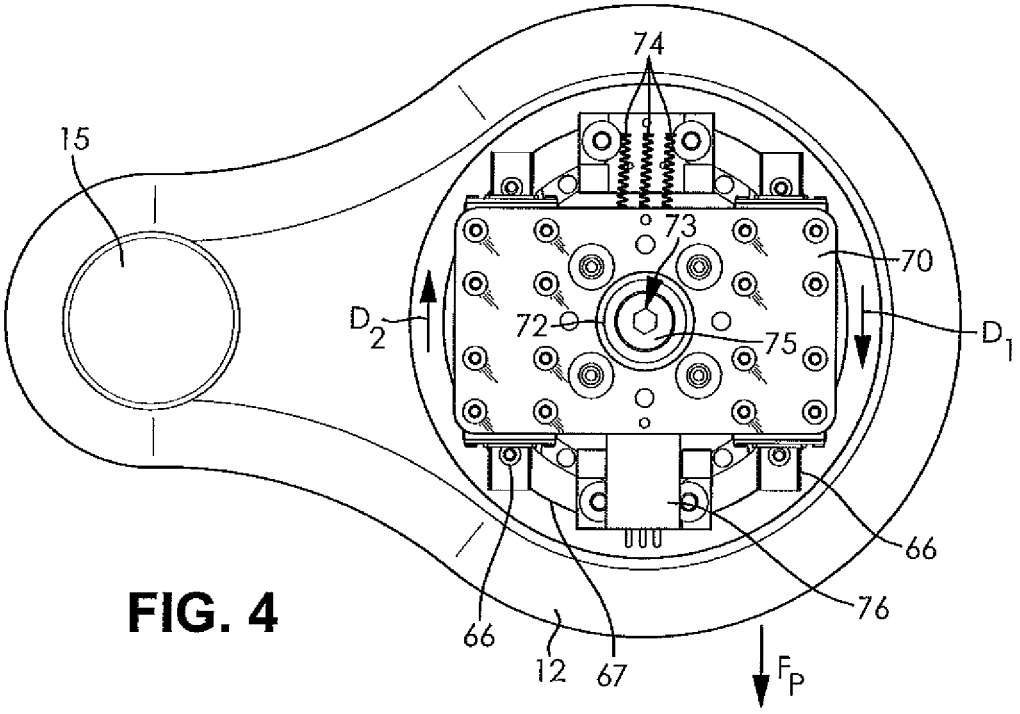
FIG. 4 is a top plan view of the mounting assembly and a base of the power-assisted winch of FIGS. 2-3.

Referring now to FIGS. 2-4, the base 12 is a generally solid member having a substantially planar surface 16. In certain embodiments, the base 12 includes an aperture 18 formed therethrough and a recessed portion 22, circumferentially formed adjacent the aperture 18 in the base 12. Those skilled in the art will appreciate that the base 12 can have any size, shape, and configuration as desired. The base 12 is formed from a material having a suitable strength to withstand stresses and strains during use of the winch 10, as well as a suitable corrosion resistance to withstand exposure to various environmental conditions. For example, the base 12 can be formed from a metal material such as aluminum, stainless steel, and titanium, a non-metal material such as silicon, a ceramic material, a polymeric material, other materials, or any combination thereof. It is also understood that the base 12 may include a corrosion resistant coating to further withstand exposure to the various environmental conditions.

The base 12 is configured as a mounting structure for the drum 14. The drum 14 can be any conventional winch drum such as the drum for a self-tailing winch disclosed in U.S. Pat. No. 3,985,340 to Guangorena, which is incorporated herein by reference in its entirety. The drum 14 shown includes a substantially cylindrical hollow casing 24 having a lower annular end portion forming a drum base 26, an upper annular end portion forming a drum head 28, and an intermediate portion 30 formed therebetween. A diameter of the intermediate portion 30 is smaller than a diameter of each of the drum base 26 and the drum head 28 to guide and maintain the line therebetween. A self-tailing device 20 may be incorporated in the drum 14 if desired. Typically, the self-tailing device 20 is formed by a circumferential gripping groove configured to firmly hold the line therein. Any conventional self-tailing device can be employed such as the self-tailing device disclosed in U.S. Pat. No. 6,250,607 to Strom, which is incorporated herein by reference in its entirety.

The drum 14 also includes a gear assembly 31. The gear assembly 31, shown in FIG. 2, includes a gear housing 32 having a generally cylindrical shank 34 extending upwards and threaded to a drum nut 36 adjacent an upper end of the gear housing 32. The shank 34 surrounds a main rotary shaft 40 and includes at least one antifriction bearing 42. A suitable driving connection for the shaft 40 may be provided at the upper end by a broached key portion 48. In certain embodiments, the shaft 40 receives an auxiliary shaft (not shown) disposed within the shaft 40 extending from the upper end to the base 12. The auxiliary shaft can include a key end configured to engage the key portion 48 and drive the shaft 40, causing a rotational movement thereof. Alternatively, when unassisted manual operation is desired, the key portion 48 can receive a key end of a lever (not shown) to drive the shaft 40 and cause the rotational movement thereof. The shaft 40 drives the drum 14 through a gear train 54. The gear train 54 may be of conventional design, having a gear (not shown) on the shaft 40 configured to engage an upper gear 58 disposed on a shaft 60 supported by a lower portion of the gear housing 32. The gear 58 is coupled to a lower gear 62 configured to engage internal teeth (not shown) on the drum base 26 of the drum 14. Other gear arrangements could be used for driving the drum 14, now known or later developed, if desired.

The drum 14 can be coupled to the base 12 in such a manner so as to permit a power source 63 such as a single speed electric motor, a variable speed hydraulic or electric motor, and the like, for example, to be selectively activated. A switch (not shown) may be provided to permit the user to selectively control an operational mode (e.g. ON, OFF, HI, LO, etc.) of the power source 63. In certain embodiments, the drum 14, and more particularly the gear assembly 31 of the drum 14, is coupled to the base 12 by a mounting assembly 64. The mounting assembly 64 includes a pair of spaced apart guide rails 66 and mounting plates 68, 70 slideably coupled to the guide rails 66. The gear assembly 31, the guide rails 66, and the mounting plates 68, 70 can be coupled together and to the base 12 by various means such as mechanical fasteners, bearings, adhesive, clips, and the like, for example, or by various processes such as by soldering, welding, brazing, and the like, for example. The guide rails 66 can also be directly mounted to the base 12, as desired. Those skilled in the art will appreciate that the drum 14 can be coupled to the base 12 by any suitable means as desired.

A coupling assembly 73 is employed to rotatably couple the drum 14 to the power source 63. In certain embodiments, the coupling assembly 73 includes a socket 75 for coupling to the power source 63 by a coupling means such as a universal coupler, for example. As shown, the socket 75 extends through central apertures 71, 72 formed in the mounting plates 68, 70 to receive the auxiliary shaft therein. Those skilled in the art will appreciate that the drum 14 can be rotatably coupled to the power source 63 by any means as desired.

The guide rails 66 and one or more urging mechanisms 74 permit the mounting plate 70 to engage and disengage a trigger mechanism 76 for selectively activating the power source 63. The urging mechanism 74 can be a helical spring, elastic bands, and the like, for example. In the embodiment shown, the mounting assembly 64 includes the urging mechanisms 74 and trigger mechanism 76 coupled thereto. The mounting assembly 64 further includes a mounting base 67 for coupling the mounting assembly 64 to the base 12 so that a position of the mounting assembly 64, the urging mechanisms 74, and the trigger mechanism 76 in respect of the fairlead 15 can be manipulated such as by a rotational movement thereof, for example. However it is understood the urging mechanism 74 and the trigger mechanism 76 can be positioned any where as desired such as directly to the base or directly to a portion of the sailing vessel, for example.

In certain embodiments, the mounting assembly 64, the urging mechanisms 74, and the trigger mechanism 76, with respect of the fairlead 15 are positioned so the trigger mechanism 76 is configured to be engaged when the direction of the wind load exerted on the line is substantially perpendicular to the direction of a pulling force $F_p$ exerted on the line by the user to minimize forces exerted on the line opposite the pulling force $F_p$. Additionally, as shown, the mounting assembly 64, the urging mechanisms 74, and the trigger mechanism 76 are positioned for use on a starboard side of the sailing vessel. However, the mounting assembly 64, the urging mechanisms 74, and the trigger mechanism 76 can be positioned for use on the port side of the sailing vessel by a repositioning thereof.

In certain embodiments, it is understood the winch 10 may further include other control mechanisms (not shown)

configured to either deactivate or militate against an undesired activation of the power source 63 when the sailing vessel is listing more than a predetermined degree of heel in a certain direction. The control mechanism may employ a device such as a sensor or switch using a gyroscope or an inertial measurement unit (IMU), for example, which detects an orientation of the sailing vessel. It is understood that any suitable control mechanism can be employed as desired.

As shown, the guide rails 66, the mounting plates 68, 70, and the trigger mechanism 76 are configured to be at least partially received in the recessed portion 22 of the base 12, allowing the drum base 26 to be positioned adjacent the surface 16 of the base 12. As such, the casing 24 of the drum 14 militates against exposure of the mounting assembly 64 to the environmental conditions. It is understood that an interior of the drum 14 and/or an interior of the recessed portion 22 of the base 12 may be closed and sealed to militate against exposure to the environmental conditions, as well as maintain lubrication of the gear assembly 31 and the guide rails 66. It is also understood that a drainage system can be employed to further militate against corrosion caused by exposure to the environmental conditions.

In certain embodiments, the trigger mechanism 76 is a switch such as a microswitch, for example. The trigger mechanism 76 is selectively engaged by the mounting plate 70 being urged into contact therewith. When engaged, the trigger mechanism 76 permits electrical energy to pass from a source of electrical energy 78, such as a battery, for example, through an electrical circuit to the power source 63. In particular embodiments, the power source 63 and the source of electrical energy 78 are disposed adjacent, underneath, or within the portion of the sailing vessel 13 having the winch 10 coupled thereto. It is understood, however, that each of the power source 63 and the source of electrical energy 78 may be disposed in any suitable location as desired.

In other embodiments, the trigger mechanism 76 is a conductor coupled to an insulated or non-conductive mount. At least a portion of the mounting assembly 64 is configured to selectively engage the conductor to close the electrical circuit and permit the electrical energy to pass from the source of electrical energy 78 through the conductor to the power source 63. Accordingly, the conductor requires no electronics which could potentially malfunction, as well as allows exposure of the winch 10 to the environmental conditions.

In operation, the line is coiled around the drum 14. Alternatively, the line may be guided around the fairlead 15 prior to being coiled around the drum 14. During a rotation of the drum 14 in a hauling direction (clockwise), the user exerts the pulling force $F_p$ on the line so that the line coiled about the drum 14 is drawn tightly around and the drum 14. The pulling force $F_p$ exerted on the line causes the drum 14 to engage the trigger mechanism 76 which activates the power source 63. More particularly, the pulling force $F_p$ exerted on the line causes the drum 14 to move in a first direction $D_1$ towards the user and the mounting plate 70 to slide along the guide rails 66 towards the trigger mechanism 76. When the trigger mechanism 76 is engaged by at least a portion of the mounting assembly 64 such as the mounting plate 70, for example, the power source 63 is activated to provide power to the drum 14 and assist with hauling the line. As the pulling force $F_p$ on the line is relaxed, the urging mechanisms 74 cause the drum 14 to move in an opposite second direction $D_2$ away from the user and the mounting plate 70 to slide along the guide rails 66 away from the trigger mechanism 76. Eventually, the portion of the mounting assembly 64 disengages the trigger mechanism 76 which deactivates the power source 63.

In other embodiments, the trigger mechanism 76 can be a load cell, a torque sensor, a pressure resistor, or any other suitable sensor or transducer, for example. In this instance, the trigger mechanism 76 generates and transmits at least one signal which represents forces applied thereto such as a signal representing the pulling force $F_p$ exerted on the line by the user and a signal representing the wind load exerted on the line, for example. A microcontroller 80 is configured to receive the signals from the trigger mechanism 76 to activate or deactivate the power source 63. In certain embodiments, a torque and/or a speed of the power source 63 varies based upon the forces applied to the trigger mechanism 76. For example, when the microcontroller 80 detects an increase in the forces applied to the trigger mechanism 76 from the signals received from the trigger mechanism 76, the torque and/or the speed of the power source 63 is caused to increase by a controller such as the microcontroller 80, for example. Conversely, when the microcontroller 80 detects a decrease in the forces applied to the trigger mechanism 76 from the signals received from the trigger mechanism 76, the torque and/or the speed of the power source 63 is caused to decrease by the microcontroller 80. It is understood that the power provided by the power source 63 may also vary based upon the forces applied to the trigger mechanism 76 depending upon the adjustments to the torque and/or the speed of the power source 63.

Further, the microcontroller 80 may use signal conditioning to filter out the signals representing the wind load, allowing the pulling force $F_p$ of the user to be isolated and the power source 63 to be activated without the need for contact by another mechanical system such as the mounting assembly 64, for example. The microcontroller 80 may also eliminate the need of the fairlead 15 to direct the line around the drum 14 in such a manner that the direction of the wind load exerted on the line is substantially perpendicular to the direction of the pulling force $F_p$ exerted on the line by the user to minimize forces exerted on the line opposite the pulling force $F_p$.

In operation, with the use of the microcontroller 80, the line is coiled around the drum 14 or guided around the fairlead 15 prior to being coiled around the drum 14. During a rotation of the drum 14 in a hauling direction (clockwise) the user exerts the pulling force $F_p$ on the line so that the line coiled about the drum 14 is drawn tightly around and the drum 14. The pulling force $F_p$ exerted on the line causes the drum 14 to exert a force on the trigger mechanism 76 which activates the power source 63. In response to the force exerted on the trigger mechanism 76, the trigger mechanism 76 generates and transmits at least one signal representing the pulling force $F_p$ exerted on the line by the user. The trigger mechanism 76 may also generate a signal representing the wind load exerted on the line. The microcontroller 80 then receives and analyzes the signals from the trigger mechanism 76, and activates the power source 63. As the pulling force $F_p$ on the line is relaxed, the force exerted on the trigger mechanism 76 is decreased and the trigger mechanism 76 generates and transmits at least one signal representing the decrease of pulling force $F_p$ exerted on the line by the user. The microcontroller 80 then receives and analyses the signals from the trigger mechanism 76 representing the decrease of pulling force $F_p$ exerted on the line, and thereby deactivates the power source 63.

Various other sensors and devices can be employed to facilitate selective activation of the power source 63 if desired. Further embodiments of selectively activating the power source 63, by engagement of the trigger mechanism 76, thus activating the rotatable drum 14 will now be discussed.

Figure 5:
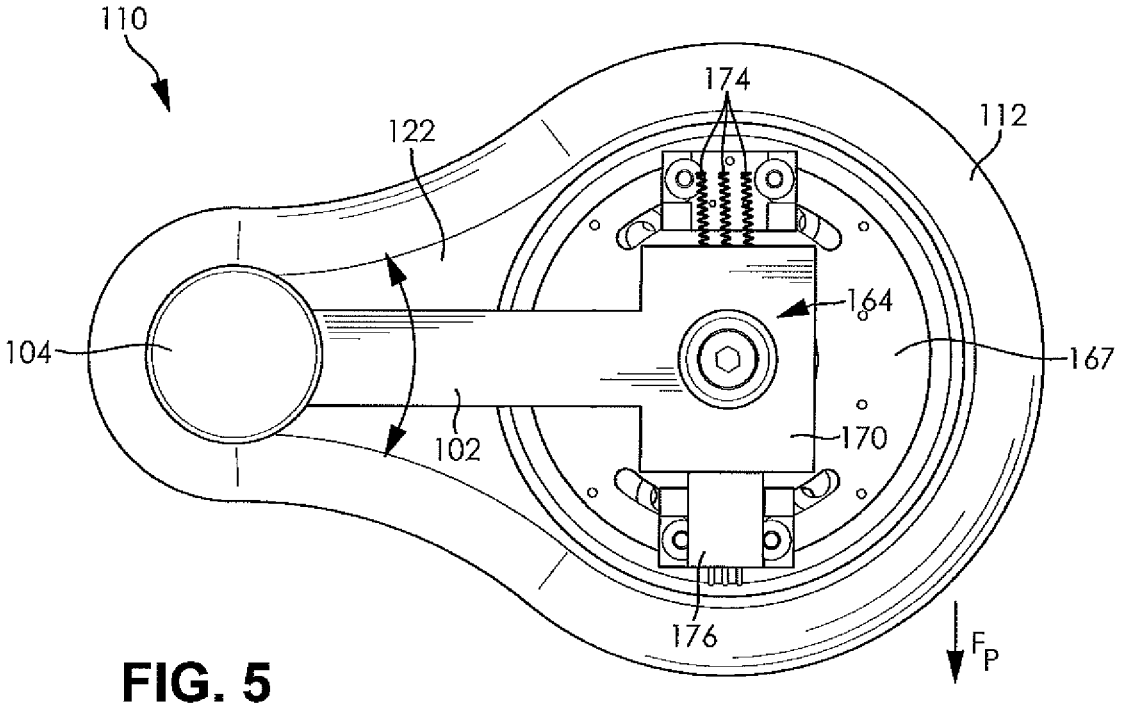
FIG. 5 is a top plan view of a mounting assembly and a base of a power-assisted winch according to a further embodiment of the invention.

FIG. 5 illustrates a power assisted winch 110 according to another embodiment of the invention. Similar reference numerals are used to describe features substantially similar to those described in FIGS. 1-4, except with a number "1" placed before such reference numerals. The winch 110 is substantially similar to the winch 10 shown in FIGS. 1-4, and described hereinabove, except that the mounting assembly 164 includes a pivot member 102 coupled to a pivot 104 disposed in the recessed portion 122 of the base 112. The pivot member 102 can be any bar, stock, angle stock, or any other member as desired configured to be coupled to and pivot about the pivot 104. The pivot 104 can include a pin, bearing, bushing, collar, sleeve or any other device facilitating the pivot member 102 to pivotally engage with the pivot 104. The pivot 104 can provide a point about which the user exerts a pulling force $F_p$ on a line, and thereby advantageously provides a lever arm for the user to pull against. The pivot member 102 is attached to the mounting plate 170. Although, it is understood the pivot member 102 can also be integrally formed with the mounting plate 170. The pivot member 102 cooperates with the urging mechanisms 174 to permit the mounting plate 170 to engage and disengage the trigger mechanism 176.

Figure 6:
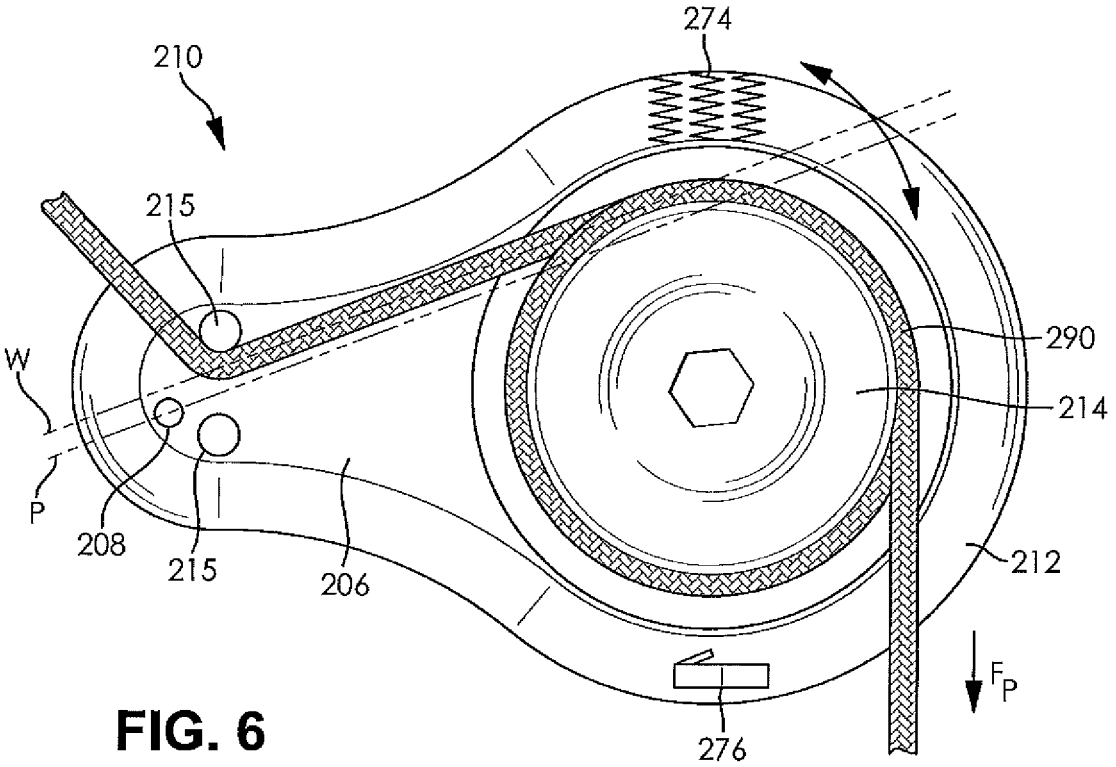
FIG. 6 is a top plan view of a mounting assembly and a base of a power-assisted winch according to a further embodiment of the invention, wherein a line is shown cooperating with the winch.

Referring now to FIG. 6, a power-assisted winch 210 according to yet another embodiment of the invention is illustrated. Similar reference numerals are used to describe features substantially similar to those described in FIGS. 1-5, except with a number "2" placed before such reference numerals. The winch 210 is substantially similar to the winch 10, 110 shown in FIGS. 1-5 and described hereinabove, except a rotatable drum 214 of the winch 210 is mounted on a rotatable platform 206. The rotatable platform 206 is coupled to the base 212 of the winch 210 by a pivot 208 such a pivot pin, for example. The rotatable platform 206 moves about the pivot 208 to engage and disengage the trigger mechanism. The pivot 208 can provide a point about which the user exerts a pulling force $F_p$ on a line 290, and thereby advantageously provides a lever arm for the user to pull against. In the embodiment shown, the trigger mechanism 176 and the urging mechanism 274 are positioned on an exterior surface of the base 212 so that the rotatable platform 206 can engage with the trigger mechanism 276 upon a pulling force $F_p$. However, it is understood the trigger mechanism 276 and urging mechanism 274 can be contained within the base 212 or contained within any other containing feature to protect the trigger mechanism 276 and urging mechanism 274 from environmental conditions.

The line 290 is shown coiled about the rotatable drum 214 to illustrate a position of the pivot 208 according to an embodiment of the invention. In certain embodiments, the pivot 208 is positioned along a pivot axis P offset from and parallel to a direction W of the line 290 from the fairlead 215 to the rotatable drum 214, or alternatively, the direction W of the wind load exerted on the line 290. In certain embodiments, the winch 210 can include more than one fairlead 215 such as a pair of fairleads as illustrated in FIG. 5. Having more than one fairlead 215 can allow for adjustment or redirection of the line 290 depending on the wind load and/or pulling force $F_p$.

Figure 7:
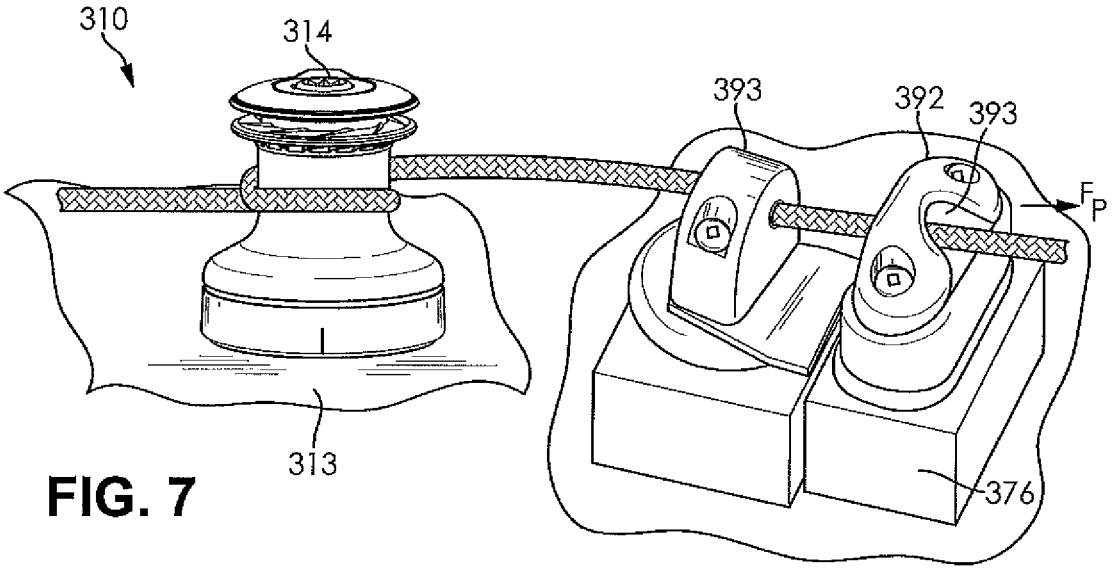
FIG. 7 is a schematic perspective diagram of a power-assisted winch and a retaining feature according to further embodiment of the invention.

Referring now to FIG. 7, a power-assisted winch 310 according to another embodiment of the invention is illustrated. Similar reference numerals are used to describe features substantially similar to those described in FIGS. 1-6, except with a number "3" placed before such reference numerals. The winch 310 is substantially similar to the winch 10, 110, 210 shown in FIGS. 1-6 and described hereinabove, except the trigger mechanism 376 engages with a retaining feature 392 such as a cleat used to secure the line or any other device used to secure the line such as a hook, pulley, eye bolt, and the like, for example. The retaining feature 392 can be disposed downstream of the rotatable drum 314 with respect to a direction of the pulling force $F_p$ being exerted on the line. The retaining feature 392 includes one or more openings 393 for receiving the line therethough and can also include a set of inwardly facing teeth engaging with the line to maintain the line within the retaining feature 392 so that the line does not move in a direction opposite the direction of the pulling force $F_p$. The retaining feature 392 can engage with the trigger mechanism 376 upon a pulling force $F_p$. When the pulling force $F_p$ is no longer being applied to the line and the line is secured in the retaining feature 392, the trigger mechanism 376 selectively deactivates the power source.

Figure 8:
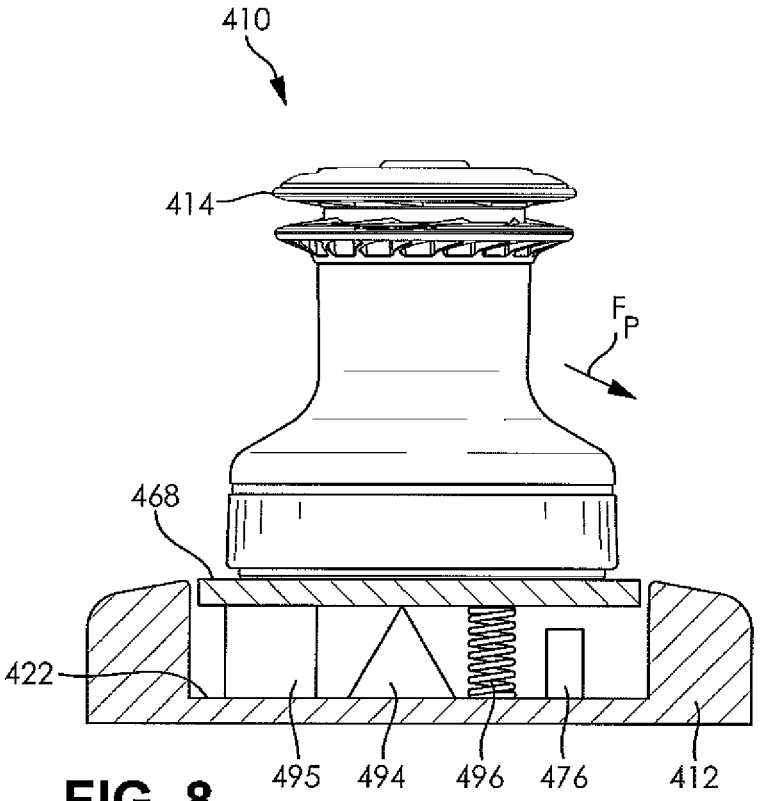
FIG. 8 is a cross-sectional view of a base of the power-assisted winch of FIG. 1 taken along the line A-A, wherein a schematic diagram of a mounting assembly according to a further embodiment of the invention is illustrated.

FIG. 8 illustrates a power-assisted winch 410 according to another embodiment of the invention. Similar reference numerals are used to describe features substantially similar to those described in FIGS. 1-7, except with a number "4" placed before such reference numerals. The winch 410 is substantially similar to the winch 10, 110, 210, 310 shown in FIGS. 1-7 and described hereinabove, except that the rotatable drum 414 is pivotally mounted on a fulcrum 494 to cause the trigger mechanism 476 to be selectively engaged and disengaged. The rotatable drum 414 can be supported on the mounting plate 468 supported by a support member 495 disposed in the recessed portion 422 of the base 412. A biasing member 496 such as a spring can cooperate with the fulcrum 494 to permit the rotatable drum 414 and thus the mounting plate 468 to pivot about the fulcrum 494 upon a pulling force $F_p$ and engage with the trigger mechanism 476. When the pulling force $F_p$ is not being applied, the biasing member 496 permits the mounting plate 468 to return to a substantially equilibrium position with respect of the fulcrum 494. Use of the fulcrum 494 may provide a mechanical advantage over prior art winches since the pulling force $F_p$ exerted on the line by the user would be from a height on the winch 410.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A power-assisted winch, comprising:

a base having a recess formed therein;

a mounting assembly disposed within the recess of the base, the mounting assembly including a mounting plate and a trigger mechanism disposed adjacent the mounting plate, the mounting plate slideably coupled to the base and positionable in a first position and a second position, wherein in the first position the mounting plate engages the trigger mechanism and in the second position the mounting plate disengages the trigger mechanism; and a drum coupled to the mounting plate to rotate about an axis that is fixed to the mounting assembly, the drum including a cylindrical casing having a gear assembly disposed therein; and a power source coupled the gear assembly, wherein the power source is configured to rotate the drum when the power source is activated by engagement of the trigger mechanism.

2. The power-assisted winch of claim 1, wherein the trigger mechanism is at least one of a switch, a conductor, a load cell, a torque sensor, and a pressure resistor.

3. The power-assisted winch of claim 1, wherein the mounting assembly comprises an urging mechanism configured to bias the mounting plate towards the second position.

4. The power-assisted winch of claim 3, wherein the urging mechanism is a spring disposed opposite the trigger mechanism with respect to the mounting plate.

5. The power-assisted winch of claim 1, wherein the mounting assembly further includes a mounting base disposed within the recess, and wherein the mounting plate is slideably coupled to the mounting base.

6. The power-assisted winch of claim 5, wherein the mounting plate is slideably coupled to the mounting base by at least one guide rail.

7. The power-assisted winch of claim 1, wherein the casing of the drum includes an upper annular end, a lower annular end forming a drum base, and an intermediate portion formed between the upper annular end and the lower annular end, the intermediate portion having a smaller diameter than each of the upper annular end and the drum base.

8. The power-assisted winch of claim 7, wherein the gear assembly includes a gear housing coupled to the mounting plate, a portion of the gear assembly disposed within the casing.

9. The power-assisted winch of claim 8, wherein the gear assembly includes a cylindrical shank extending from an upper end of the gear housing, the cylindrical shank formed concentric with the axis.

10. The power-assisted winch of claim 9, wherein the gear assembly includes a bearing disposed on the cylindrical shank, the bearing rotatable about the axis and received within the intermediate portion of the casing, wherein the intermediate portion engages the bearing.

11. The power-assisted winch of claim 10, wherein the gear assembly includes a gear train disposed within the gear housing, the gear train engaged with each of the drum base and a shaft of the gear assembly, wherein the gear train is configured to transfer rotational motion from the shaft to the drum.

12. The power-assisted winch of claim 11, wherein the gear train includes a first gear engaged with the shaft and a second gear engaged with the drum.

13. The power-assisted winch of claim 12, wherein the axis comprises a coupling assembly having a socket, the cooperating with each of the power source and the shaft of the gear assembly.

14. The power-assisted winch of claim 9, wherein the gear housing of the gear assembly is received within the drum base.

* * * * *